US008042917B2

(12) United States Patent
Azumi

(10) Patent No.: US 8,042,917 B2
(45) Date of Patent: Oct. 25, 2011

(54) LIQUID DISPENSER HEAD, LIQUID DISPENSING UNIT USING SAME, IMAGE FORMING APPARATUS USING SAME, AND METHOD OF MANUFACTURING LIQUID DISPENSER HEAD

(75) Inventor: Junichi Azumi, Sendal (JP)

(73) Assignee: Ricoh Company, Ltd., Tokyo (JP)

( * ) Notice: Subject to any disclaimer, the term of this patent is extended or adjusted under 35 U.S.C. 154(b) by 967 days.

(21) Appl. No.: 11/931,739

(22) Filed: Oct. 31, 2007

(65) Prior Publication Data

US 2008/0100674 A1 May 1, 2008

(30) Foreign Application Priority Data

Oct. 31, 2006 (JP) ..... 2006-296160

(51) Int. Cl.
*B41J 2/025* (2006.01)

(52) U.S. Cl. ..... 347/70

(58) Field of Classification Search ..... None
See application file for complete search history.

(56) References Cited

U.S. PATENT DOCUMENTS

| | | | | |
|---|---|---|---|---|
| 6,332,669 | B1 | 12/2001 | Kato et al. | |
| 6,497,474 | B2 | 12/2002 | Irinoda et al. | |
| 7,156,504 | B2 * | 1/2007 | Akahane | 347/70 |

FOREIGN PATENT DOCUMENTS

| | | |
|---|---|---|
| JP | 2640304 | 5/1997 |
| JP | 11-198368 | 7/1999 |
| JP | 11-298114 | 10/1999 |
| JP | 2001-121690 | 5/2001 |
| JP | 3503661 | 12/2003 |
| JP | 2004-284196 | 10/2004 |
| JP | 2005-81790 | 3/2005 |
| JP | 2005-265784 | 9/2005 |
| WO | WO93/25390 | 12/1993 |

* cited by examiner

*Primary Examiner* — Jerry Rahll
(74) *Attorney, Agent, or Firm* — Cooper & Dunham LLP

(57) ABSTRACT

A liquid dispenser head includes a plurality of nozzles, a plurality of liquid chambers, and a plurality of vibration members. The nozzle is used to discharge liquid. The liquid chamber communicates with the nozzle. The vibration member has a vibration portion, which is used as a deformable wall face of the liquid chamber. The vibration member includes a metal member and a resin layer directly formed on the metal member, and the resin layer has a coefficient of linear expansion greater than a coefficient of linear expansion of the metal member.

11 Claims, 13 Drawing Sheets

FIG. 10

| | COMPOUND A | COMPOUND B | COMPOUND C | COMPOUND D |
|---|---|---|---|---|
| CTE OF RESIN LAYER (ppm/K) | 14.7 | 18.4 | 23.5 | 26.9 |
| DEFORMATION OF 4.5mm × 4.5mm (mm) | 0.07 | 0.01 | 0.005 | 0.005 |
| DISCHARGE PERFORMANCE | × | ○ | ○ | ○ |

LIQUID DISPENSER HEAD, LIQUID DISPENSING UNIT USING SAME, IMAGE FORMING APPARATUS USING SAME, AND METHOD OF MANUFACTURING LIQUID DISPENSER HEAD

CROSS-REFERENCE TO RELATED APPLICATIONS

This application claims priority from Japanese Patent Application No. 2006-296160, filed on Oct. 31, 2006 in the Japan Patent Office, the entire contents of which are hereby incorporated by reference herein.

BACKGROUND

1. Technical Field

The present disclosure relates generally to a method of manufacturing a liquid dispenser head, the liquid dispenser head, a liquid dispensing unit having the liquid dispenser head, and an image forming apparatus having the liquid dispenser head.

2. Description of the Background Art

In general, an image forming apparatus is available as a printer, a facsimile machine, a copier, a plotter, or a multi-functional apparatus having multiple functions thereof. Such image forming apparatus may include a liquid dispensing unit having a liquid dispensing head (or a recording head) for dispensing droplets of recording liquid onto a recording sheet to form an image on the recording sheet.

Such sheet includes, but is not limited to, a medium made of material such as paper, string, fiber, cloth, leather, metal, plastic, glass, timber, and ceramic, for example. Further, the term "image formation" used herein refers to providing, recording, printing, or imaging an image, a letter, a figure, or a pattern to a sheet. Moreover, the term "liquid" used herein is not limited to recording liquid or ink but includes anything discharged in fluid form. Hereinafter, the recording liquid is referred to as ink for simplicity of description.

Furthermore, a liquid dispensing unit having a liquid dispenser head can be used in any application area, including, but not limited to, forming an image on a sheet, dispensing liquid for specific purposes (e.g., fabrication of semiconductor), and the like.

Such liquid dispensing unit or image forming apparatus have found industrial applications in such fields as cloth-printing apparatuses and metal wiring devices, while commercial demand for better image quality and faster printing speed continues to grow.

In view of such demand for better image quality, nozzle density, or a number of nozzles per unit area of the liquid dispenser head, continues to increase, narrowing spacing between pressure chambers of a recording head and increasing an energy frequency, or number of vibrations applied to the recording head.

Further, in view of such demand for faster printing speed, a line printer having page-wide arrays (PWA) of recording head has been developed. The main advantage of such PWA head is that it has a length sufficient to print a single line image on a recording medium with a single liquid discharge. However, a drawback of such PWA head is that its manufacture requires consistently high precision to very narrow tolerances.

In general, a recording head or liquid dispenser head includes a nozzle, a liquid chamber that communicates with the nozzle, and a pressure generator to generate pressure for discharging liquid droplets from the nozzle.

Such recording head may use known methods for discharging liquid droplets, such as a thermal method, a piezoelectric method, and an electrostatic method. In the thermal method, an electricity-heat conversion element such as a heating resistor is used to cause a film boiling of liquid. In the piezoelectric method, an electricity-mechanical energy conversion element such as a piezoelectric element is used. In the electrostatic method, an electrostatic actuator, which generates electrostatic force, is used.

A liquid dispenser head employing a piezoelectric element may have an elastically deformable vibration plate, with a protruded portion (or convex portion, or island portion) provided on the vibration plate in a direction extending in a longitudinal direction of the liquid chamber, in which a displacement energy of the piezoelectric element is transmitted to the vibration plate via the protruded portion.

Such protruded portion is provided on the vibration plate to effectively deform a wall face of the liquid chamber and to suppress interference between adjoining liquid chambers.

In general, the vibration plate is made of polymer film bonded to a thin metal plate. For example, the polymer film is bonded to the thin metal plate with an adhesive agent and the thin metal plate is etched to form the protruded portion (or island portion), in which an area other than the island portion may be coated with the adhesive agent.

Alternatively, a thermosetting resin such as thermosetting polyimide may be directly applied to a SUS (stainless steel) plate to form the vibration plate.

Although such polymer film product or thin metal plate product may have a variable thickness, such thickness in variation of product may similarly appear when manufacturing products having different sizes. For example, a thickness in variation of a polymer film having larger area and a polymer film having smaller area may have a similar trend, as may a thickness variation of a thin metal plate having larger area and a thin metal plate having smaller area.

Accordingly, even if the liquid dispenser head is enlarged or lengthened, the thickness (or height) of the protruded portion of the vibration plate can be controlled to within a given thickness variation.

A different problem arises, however, in that an etching with etchant is conducted on the thin metal plate of the vibration plate, which is prepared by bonding the polymer film to the thin metal plate with an adhesive agent as described above. Consequently, the adhesive agent may come into contact with the etchant during the etching, by which the adhesive layer may be eroded or partially degraded by the etchant. Such erosion or degeneration of the adhesive layer may cause variation in thickness of the vibration plate, which may result in unacceptable variation in vibration performance of the vibration plate.

Furthermore, variation in thickness of the polymer film and variation in thickness of the adhesive layer may cause unacceptable variation in vibration performance of the vibration plate.

If a resin layer such as a polyimide is directly applied to and formed on the thin metal plate (e.g., SUS plate) without using an adhesive layer, such variation in thickness of the adhesive layer is, of course, no longer an issue for liquid dispenser head manufacture.

Such resin material (e.g., polyimide) must be heated to a higher temperature for imidization and cooled to room temperature to form a vibration plate having a resin layer formed directly on a metal plate, wherein such method is called a varnish method.

After forming the resin layer on the metal plate, some portion of the metal plate is removed by etching. When such etching is conducted, a portion of the resin layer corresponding to a removed portion of the metal plate (i.e., etched portion of the metal plate) may wrinkle.

More specifically, the vibration plate has a vibrating portion made of a resin layer and a protruded portion (or island portion) made of a metal layer. Such protruded portion of the vibration plate is bonded to a piezoelectric element.

Because some portion of the metal layer is removed by etching to form the protruded portion, some portion of the resin layer, which corresponds to the removed portion of the metal layer, is no longer bonded to the metal layer. Such portion of the resin layer may be termed a "resin only portion," and wrinkles are more likely to appear in such resin only portion area of the resin layer.

If such wrinkles do appear in the resin layer of the vibration plate, displacement energy of the piezoelectric element may not be effectively transmitted to the liquid chamber, thus degrading droplet discharge performance or creating unacceptable variation in the droplet discharge performance of each liquid chamber (or nozzle).

BRIEF SUMMARY

In an aspect of this disclosure, there is provided a liquid dispenser head including a plurality of nozzles, a plurality of liquid chambers, and a plurality of vibration members. The nozzle is used to discharge liquid. The liquid chamber communicates with the nozzle. The vibration member has a vibration portion used as a deformable wall face of the liquid chamber. The vibration member includes a metal member and a resin layer formed directly on the metal member, and the resin layer has a coefficient of linear expansion greater than a coefficient of linear expansion of the metal member.

In another aspect of this disclosure, there is provided an image forming apparatus including a liquid dispenser head. The liquid dispenser head includes a plurality of nozzles, a plurality of liquid chambers, and a plurality of vibration members. The nozzle is used to discharge liquid. The liquid chamber communicates with to the nozzle. The vibration member has a vibration portion used as a deformable wall face of the liquid chamber. The vibration member includes a metal member and a resin layer formed directly on the metal member, and the resin layer has a coefficient of linear expansion greater than a coefficient of linear expansion of the metal member.

In another aspect of this disclosure, there is provided a method of manufacturing a liquid dispenser head including applying and heating. The applying applies a resin material having a coefficient of linear expansion greater than a coefficient of linear expansion of a metal member directly to the metal member. The heating heats the resin to imidize the resin material and to solidify and bond the resin material to the metal member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 10 is a table illustrating a relationship of a coefficient of thermal expansion of the resin layer of the vibration plate and deformation of the resin layer;

Figure 1:
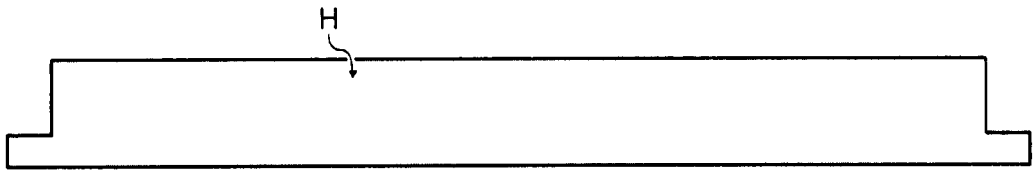
FIG. 1 illustrates a side view of a liquid dispenser head according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing example embodiments shown in the drawings, specific terminology is employed for the sake of clarity, the present disclosure is not limited to the specific terminology so selected and it is to be understood that each specific element includes all technical equivalents that operate in a similar manner.

Referring now to the drawings, a liquid dispenser head according to an example embodiment is described with particular reference to FIGS. 1 to 6.

Figure 2:
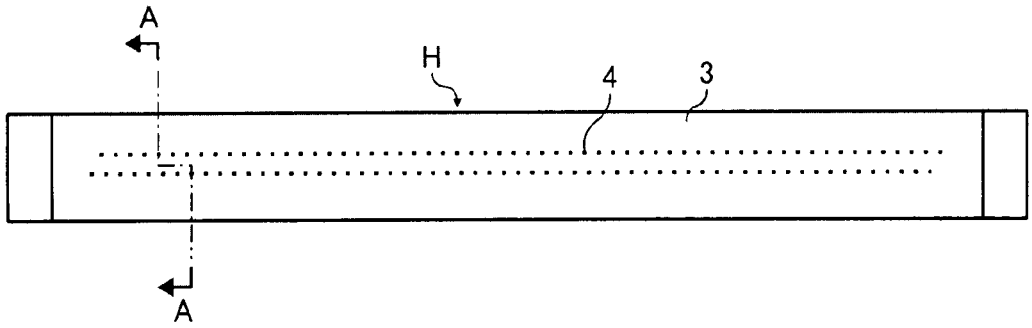
FIG. 2 illustrates a plan view of the liquid dispenser head of FIG. 1.
Figure 3:
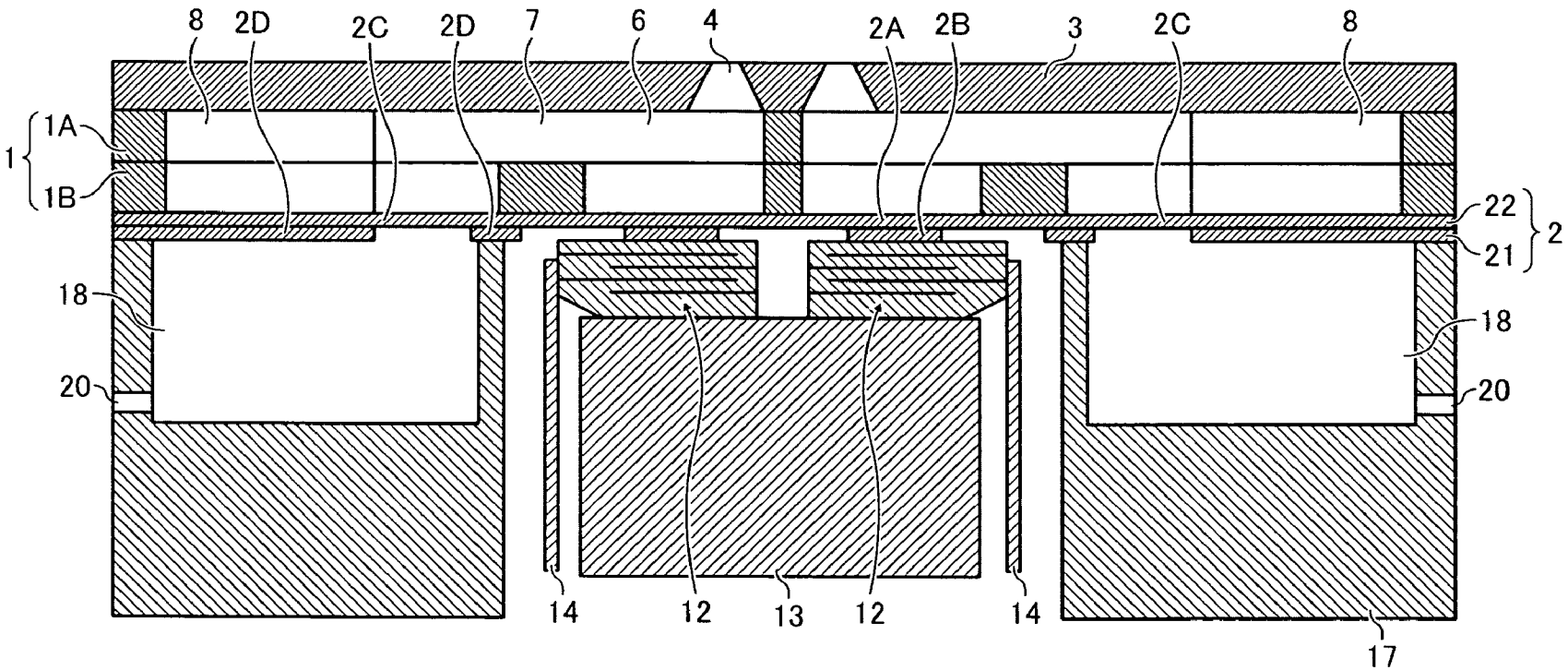
FIG. 3 illustrates a cross-sectional view of the liquid dispenser head along A-A line in FIG. 2.
Figure 4:
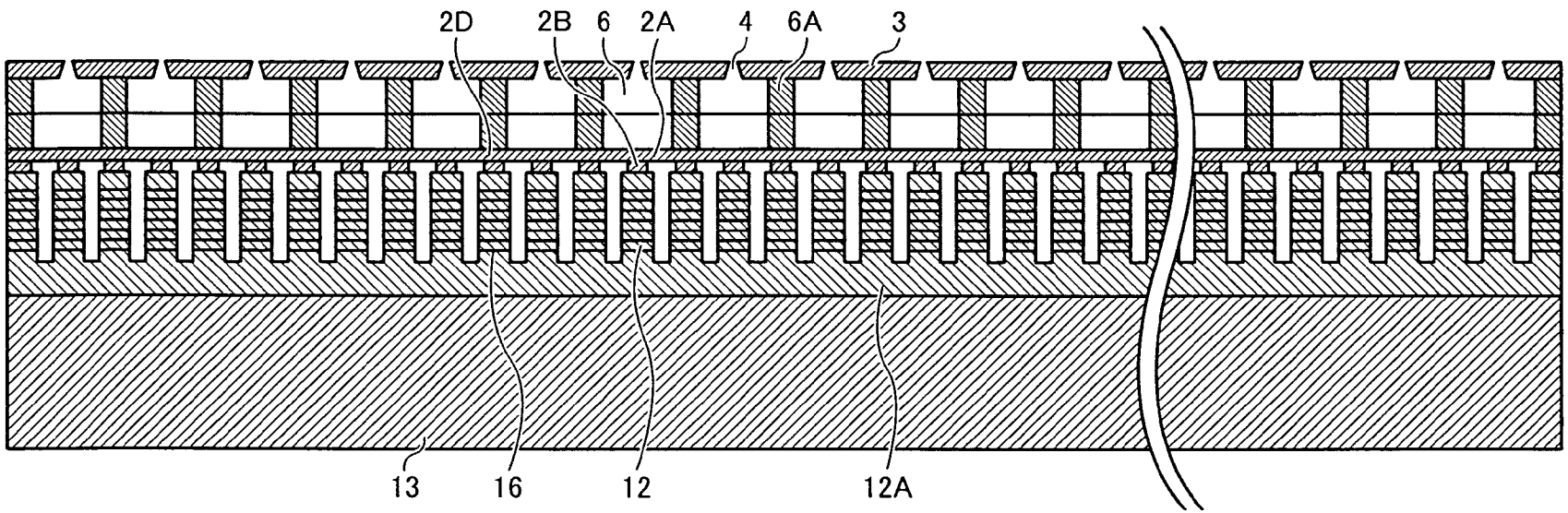
FIG. 4 illustrates a cross-sectional view of the liquid dispenser head of FIG. 1, cut along a longitudinal direction.
Figure 5:
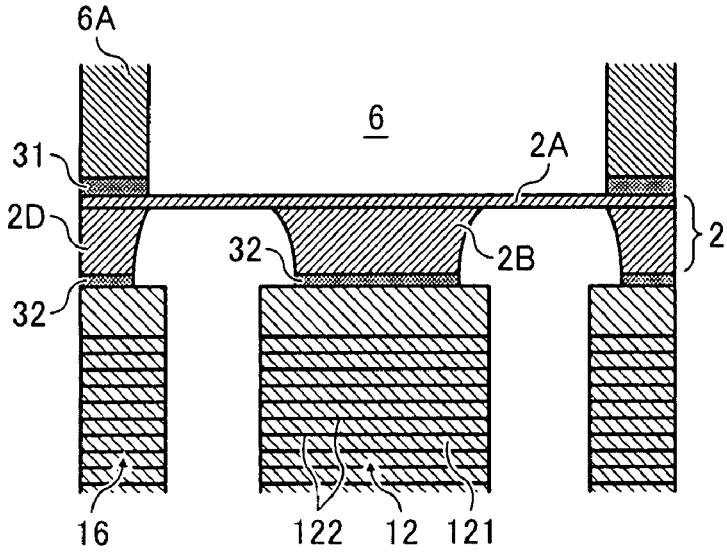
FIG. 5 illustrates an enlarged cross-sectional view of a pressure chamber of the liquid dispenser head of FIG. 1.
Figure 6:
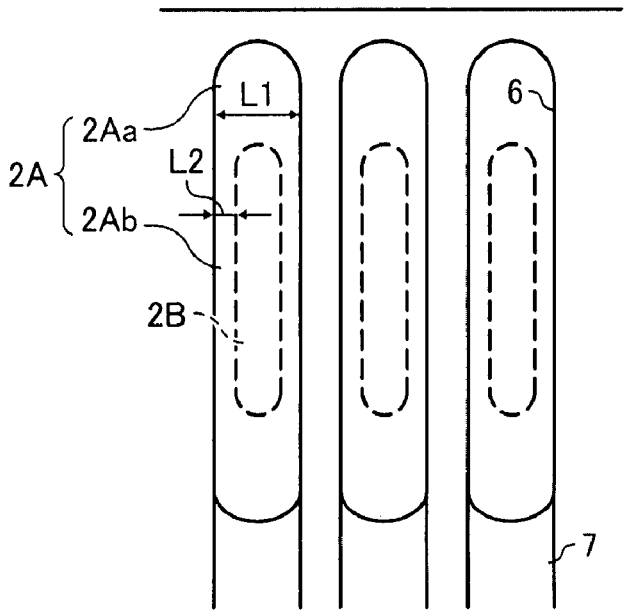
FIG. 6 illustrates a plan view of the pressure chamber of FIG. 5.

FIG. 1 illustrates a side view of the liquid dispenser head H. FIG. 2 illustrates a plan view of the liquid dispenser head H of FIG. 1. FIG. 3 illustrates a cross-sectional view of the liquid dispenser head H along the A-A line in FIG. 2. FIG. 4 illustrates a cross-sectional view of the liquid dispenser head H of FIG. 1 cut along a longitudinal direction. FIG. 5 illustrates an enlarged cross-sectional view of one pressure chamber. FIG. 6 illustrates a plan view of the pressure chamber of FIG. 5.

As illustrated in FIG. 3, the liquid dispenser head H includes a base plate 1, a vibration member 2, a nozzle plate 3 having nozzles, for example.

The vibration member 2 is bonded to one face (e.g., lower face) of the base plate 1, and the nozzle plate 3 is bonded to another face (e.g., upper face) of the base plate 1. The base plate 1 may be made of SUS (stainless) plate, for example.

Further, the liquid dispenser head H includes a pressure chamber 6, a flow restriction portion 7, and a common chamber 8, all of which are configured with the base plate 1, the vibration member 2, and the nozzle plate 3.

The pressure chamber 6 communicates a nozzle for discharging liquid droplets, and one pressure chamber may be provided for one nozzle. As illustrated in FIG. 2, the nozzle plate 3 has a plurality of nozzles, and the liquid dispenser head H includes a plurality of pressure chambers 6 as illustrated in FIG. 4.

Recording liquid (e.g., ink) is supplied from the common chamber 8 to the plurality of pressure chambers 6 through the flow restriction portion 7. Further, recording liquid is supplied to the common chamber 8 from a liquid tank (not illustrated).

As illustrated in FIG. 3, the base plate 1 is configured with a restrictor plate 1A and a chamber plate 1B, which are bonded with each other.

The pressure chamber 6, the flow restriction portion 7, and the common chamber 8 can be formed on the base plate 1 by known methods such as plate etching by acidic etching liquid, and punch press, for example. For example, the flow restriction portion 7 is formed by removing some portion of the restrictor plate 1A and by not removing a corresponding portion of the chamber plate 1B.

As illustrated in FIG. 3, the vibration member 2, bonded to the chamber plate 1B of the base plate 1, includes a metal element 21 and a resin layer 22.

Such vibration member 2 can be made by directly forming the resin layer 22 on the metal element 21 (e.g., SUS plate). For example, in an example embodiment, a resin material having a coefficient of linear expansion greater than a coefficient of linear expansion of the metal element 21 is directly applied on the metal element 21, and then heated and solidified to form the vibration member 2.

As illustrated in FIG. 3, the resin layer 22 of the vibration member 2 has a vibration portion 2A, which is a deformable portion and a wall face of the pressure chamber 6, and an island-like protruded portion 2B is formed on the metal element 21.

As illustrated in FIG. 3, the vibration portion 2A and the island-like protruded portion 2B are formed substantially faces each other in the vibration member 2. For the simplicity of expression, the island-like protruded portion 2B is termed as "island portion 2B," hereinafter.

As illustrated in FIG. 2, the nozzle plate 3 has a number of nozzles, having a given diameter (e.g., 10 μm to 30 μm), corresponded to each pressure chamber, and the nozzle plate 3 is bonded to the restrictor plate 1A of the base plate 1 with an adhesive agent. Hereinafter, one or more nozzles on the nozzle plate 3 are referred as "nozzle 4," as required. Similarly, one or more pressure chambers are referred as "pressure chamber 6."

The nozzle plate 3 can be made of a metal material (e.g., stainless steel, nickel), a resin material (e.g., polyimide resin film), or silicone, or a combination of such materials. Furthermore, the nozzle plate 3 may be coated with a water-repellency film by known methods such as metal plating or application of water-repellency agent to secure effective water-repellency to recording liquid (e.g., ink).

As illustrated in FIG. 3, a pressure generator is bonded to the island portion 2B of the vibration member 2 while one pressure generator is provided for each one of the pressure chambers. Specifically, such pressure generator may be a piezoelectric element 12, for example.

As illustrated in FIG. 3, the piezoelectric element 12 is also bonded to the base member 13. The piezoelectric element 12 may have a plurality of layers of piezoelectric elements.

As illustrated in FIG. 4, a plurality of piezoelectric elements may be formed on one piece of piezoelectric element block 12A by forming a plurality of slits on the piezoelectric element block 12A. As illustrated in FIG. 4, the piezoelectric element block 12A is fixed on the base member 13.

Further, as illustrated in FIG. 3, a FPC (flexible printed circuits) cable 14 is connected to one end face of the piezoelectric element 12 to apply a drive pulse signal to the piezoelectric element 12.

As illustrated in FIG. 5, the piezoelectric element 12 includes a piezoelectric layer 121 and an internal electrode 122, wherein the piezoelectric layer 121 is made of lead zirconium titanate (PZT) having a thickness of 10 μm to 50 μm per layer, and the internal electrode 122 is made of silver/palladium (AgPd) having a thickness of several μm per layer, for example.

More specifically, a plurality of piezoelectric layers 121 and a plurality of internal electrodes 122 are alternately stacked each other to form the piezoelectric element 12. Such internal electrode 122 has an end face, which is connected to an external electrode (not illustrated).

When the piezoelectric element 12 expands and contracts in a direction of d33, which indicates expansion and contraction of the piezoelectric element 12 in a direction (or thickness direction) perpendicular to the internal electrode 122 with an effect of piezoelectric constant of the piezoelectric element 12, the vibration portion 2A displaces its position to contract or expand a volume of the pressure chamber 6.

For example, the piezoelectric element 12 expands its volume in one direction when a drive signal is applied and charged to the piezoelectric element 12, and contracts its volume in an opposite direction when charged electricity is discharged from the piezoelectric element 12.

Although the piezoelectric element 12 is displaced in d33 direction to pressurize ink in the pressure chamber 6 in an example embodiment, the piezoelectric element 12 can be displaced in d31 direction to pressurize ink in the pressure chamber 6.

The base member 13 is preferably made of a metal material. If the base member 13 is made of metal, a heat accumulation of the piezoelectric element 12 by self-heating can be suppressed or prevented.

The piezoelectric element 12 and the base member 13 are bonded with each other with an adhesive agent. If a number of channels of the liquid dispenser head H is increased, the piezoelectric element 12 may be heated to a higher temperature (e.g., 100 degrees Celsius or so) by self-heating effect of the piezoelectric element 12. Such higher temperature condition may degrade a bonding strength of the adhesive agent bonding the piezoelectric element 12 and the base member 13.

Furthermore, when the liquid dispenser head H is heated to a higher temperature by self-heating effect of the piezoelectric element 12, ink temperature may also increase. Because ink viscosity decreases when ink temperature increases, decreased ink viscosity may cause to effect liquid dispensing performance of the liquid dispenser head H.

Accordingly, if the base member 13 is made of a metal material, heat accumulation of the piezoelectric element 12 by self-heating can be suppressed or prevented, by which a degradation of bonding strength of adhesive agent and a degradation of liquid dispensing performance due to decreased ink viscosity can be prevented.

As illustrated in FIG. 3, the vibration member 2 is also bonded to a frame 17 with an adhesive agent, and the frame 17 has a buffer room 18 therein. Such buffer room 18 is provided next to the common chamber 8 via a diaphragm section 2C (as deformable portion), which is configured with the resin layer 22 of the vibration member 2. Such diaphragm section 2C may be used a wall face for the common chamber 8 and the buffer room 18. Furthermore, the buffer room 18 is communicated to atmosphere through a communication port 20.

In the liquid dispenser head H, a plurality of piezoelectric elements are disposed each other with a given pitch such as 300 dpi (dot per inch) in one row, and two rows having such pitch (e.g., 300 dpi) are arranged in parallel in the liquid dispenser head H.

Further, a plurality of nozzles (or pressure chambers) are disposed each other with a given pitch such as 150 dpi (dot per inch) in one row, and two rows having such pitch (e.g., 150 dpi) are arranged in staggered manner as illustrated in FIG. 2, by which the liquid dispenser head H can be used to obtain an image resolution of 300 dpi by single scanning operation of the liquid dispenser head H, for example.

In such configuration, the plurality of piezoelectric elements in one row may include two types of piezoelectric elements. One type is used as piezoelectric element 12 for driving the head, and other type is not used as piezoelectric element 12 but only used as support member (hereinafter, "support member 16") although both types are made of same piezoelectric element material. As illustrated in FIG. 4, the piezoelectric element 12 and the support member 16 are alternately arranged on the piezoelectric element block 12A.

Furthermore, because the liquid dispenser head H is composed of members made of mainly SUS material having similar coefficient of thermal expansion, a drawback related to a thermal expansion of the liquid dispenser head H during assembly or usage can be suppressed.

Droplets of recording liquid can be discharged from the liquid dispenser head H as follows.

For example, a first voltage, lower than a reference voltage, is applied to the piezoelectric element 12 to contract the piezoelectric element 12. When the piezoelectric element 12 contracts, the vibration member 2 is pulled by the piezoelectric element 12. Such movement of the vibration member 2 may increase a volume of the pressure chamber 6, by which ink is induced into the pressure chamber 6 from the common chamber 8.

Then, a second voltage, increased from the first voltage, is applied to the piezoelectric element 12 to expand the piezoelectric element 12. When the piezoelectric element 12 expands, the vibration member 2 deforms its shape toward a direction of the nozzle 4, and the volume of the pressure chamber 6 is decreased, by which recording liquid in the pressure chamber 6 is pressurized and droplets of recording liquid is discharged from the nozzle 4.

After discharging a liquid droplet, a third voltage (or reference voltage) is applied to the piezoelectric element 12 and the vibration member 2 is returned to its original position. When the vibration member 2 returns to its original position, the pressure chamber 6 expands its volume, by which a negative pressure is generated in the pressure chamber 6. Accordingly, recording liquid is refilled to the pressure chamber 6 from the common chamber with an effect of such negative pressure.

When a vibration of meniscus face of the nozzle 4 is damped to a stable level, a next discharging operation of liquid droplets can be started.

The liquid dispensing head H can be driven by any head driving methods such as pull-push driving method and push driving method, for example, in which a drive pulse signal is applied to piezoelectric element 12 as follows.

In case of pull-push driving method, a voltage lower than a reference voltage is applied to a piezoelectric element to contract the piezoelectric element and increase a volume of a pressure chamber at first, and then a voltage of reference voltage is applied to the piezoelectric element to expand the piezoelectric element and to decrease the volume of the pressure chamber so that a liquid droplet is discharged from a nozzle.

In case of push driving method, a voltage greater than a reference voltage is applied to a piezoelectric to move a vibration plate toward a pressure chamber so that a liquid droplet is discharged from a nozzle.

A description is now given to the vibration member 2 of the liquid dispenser head H. The vibration member 2 is made of a metal element and a resin material as above-mentioned.

For example, a resin material having a coefficient of linear expansion greater than a coefficient of thermal expansion of the metal element 21 (e.g., SUS plate) is directly applied on the metal element 21. Then, the resin material is heated for imidization and solidification, by which the resin layer 22 is formed directly on the metal element 21 without using a bonding agent such as adhesive agent. Such resin material may be a polyimide precursor, for example.

Then, the metal element 21 is processed by an etching method to remove some portion of the metal element 21.

A portion of the metal element 21, which is not removed by etching is used as the island portion 2B, which is corresponded to the vibration portion 2A of the resin layer 22.

Another portion of the metal element 21, which is removed by etching is corresponded to the diaphragm section 2C of the resin layer 22.

Further, another portion of the metal element 21, which is not removed by the etching is used as a pillar portion 2D, wherein the pillar portion 2D is corresponded to a chamber separation wall 6A of the base plate 1 as illustrated in FIG. 5.

As illustrated in FIG. 5, the chamber separation wall 6A of the base plate 1 is bonded to the resin layer 22 of the vibration member 2 with an adhesive agent 31, and the island portion 2B is bonded to the piezoelectric element 12 with an adhesive agent 32. The pillar portion 2D is bonded to the support member 16, not used as piezoelectric element, with the adhesive agent 32.

As above described, the vibration member 2 is formed by forming the resin layer 22 on the metal element 21 by a varnish method, in which resin material, having a coefficient of linear expansion greater than a coefficient of linear expansion of the metal element 21, is directly applied on the metal element 21, heated, and solidified on the metal element 21. As above described, the resin layer 22 includes the vibration portion 2A.

When a varnish is applied on a metal and cured by heat, a resin layer formed on the metal is in a stress free condition. Such resin layer may receive stress when a temperature is cooled to a room temperature.

If the resin layer has a coefficient of linear expansion smaller than the metal, the metal contracts greater level compared to the resin layer when the temperature is cooled to a room temperature. In such a condition, when some portion of the metal is removed by etching, an internal stress of the resin layer corresponded to such removed portion of the metal may be released, by which surface deformation such as wrinkles may occur on the resin layer.

On one hand, if the resin layer has a coefficient of linear expansion greater than the metal, the resin layer contracts greater level compared to the metal when the temperature is cooled to a room temperature. In such a condition, even when some portion of the metal is removed by etching, the resin layer may effectively maintain an extended condition. Accordingly, an occurrence of wrinkles on the resin layer may be suppressed.

As illustrated in FIG. 6, a plurality of the pressure chambers 6 are arranged in parallel in the liquid dispenser head H. FIG. 6 illustrates a plan view of the vibration portion 2A.

As illustrated in FIG. 6, the vibration portion 2A includes a first portion 2Aa and a second portion 2Ab. The island portion 2B is provided under the second portion 2Ab, but not provided under the first portion 2Aa.

The first portion 2Aa is a portion having only the resin layer 22 (i.e., "resin-only layer" portion) and a width L1, which is a width of the pressure chamber 6.

The second portion 2Ab includes one portion not attached to the island portion 2B ("resin-only layer" portion) and another portion attached to the island portion 2B. Such one portion not attached to the island portion 2B has a width L2 as illustrated in FIG. 6.

In general, wrinkles may more likely to occur on the first portion 2Aa than the second portion 2Ab of the resin layer 22. If wrinkles may occur on the first portion 2Aa ("resin-only layer" portion) of the resin layer 22, the energy transmission efficiency from the piezoelectric element 12 to the pressure chamber 6 may have a variation, by which droplet discharge performance of nozzles may have variation one another, which is not desirable.

In an example embodiment, an occurrence of wrinkles on the first portion 2Aa of the resin layer 22 of the vibration member 2 can be suppressed as above described, by which a variation in droplet discharge performance of nozzles can be suppressed.

As such, the vibration portion 2A has an area formed only with a resin layer ("resin-only layer" portion), which extends in an entire width direction of the vibration portion 2A as illustrated as first portion 2Aa in FIG. 6.

With such configuration, displacement energy of piezoelectric element 12 can be effectively transmitted to the vibration portion 2A via the protruded portion (e.g., island portion 2B).

Because an occurrence of wrinkles on the vibration portion 2A of the resin layer 22 of the vibration member 2 can be suppressed as above described, a variation in droplet discharge performance of nozzles can be suppressed.

On the other hand, if a protruded portion of the vibration member 2 is not shaped in an island shape (e.g., island portion 2B) but shaped in a rectangular shape extending in an entire longitudinal direction of the pressure chamber 6, such rectangular-shaped portion may interfere with a vibration of the vibration member 2 because both ends of such rectangular-shaped portion may be fixed on both ends of the vibration member 2, in which the vibration member 2 may not vibrate effectively.

A description is now given to a method of manufacturing the vibration member 2 with reference to FIGS. 7 and 8. With reference to FIG. 7, a manufacturing process of a layered member 50 made by bonding the metal element 21 and the resin layer 22 is described. The layered member 50 is made as a base member for manufacturing the vibration member 2 (refer to FIG. 8D).

Figure 7A:
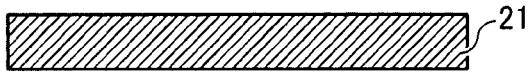
FIG. 7 illustrates a process for making a base member for a vibration plate, composed of a metal member and a resin material, according to an example embodiment.

First, as illustrated in FIG. 7A, the metal element 21 is prepared with a surface pretreatment such as cleaning. For example, tensioned-annealed SUS 304 (or SUS 304-TA) may be used as the metal element 21. Further, the metal element 21 may be made of SUS material (e.g., SUS 304, SUS 303, SUS 316, SUS 412), a metal or alloy of copper, nickel, chromium or the like, and semiconductor material such as silicon, for example.

In an example embodiment, the metal element 21 may not contact liquid (e.g., ink) to be discharged from the nozzle 4. Accordingly, a corrosion or erosion effect by liquid may not become a problem when selecting a material for the metal element 21. However, if the metal element 21 may contact liquid due to a design of recording head, a corrosion resistance material may need to be selected.

Further, when bonding the vibration member 2 and the base plate 1, or when bonding the vibration member 2 and the piezoelectric element 12, a heat having a given temperature (e.g., one hundred Celcius degrees or so) may be applied to cure an adhesive agent.

When SUS material is used, a material pretreated by heat treatment process is preferable. For example, bright-annealed material or tensioned-annealed material may be used. Further, a material not pretreated by heat treatment process can be used. Further, tensioned-annealed material treated by stress relief process is preferable for a longer head or full-line head unit.

The metal element 21 is preferably prepared with a surface pretreatment such as cleaning with a solvent to remove grease from the metal element 21.

Figure 7B:
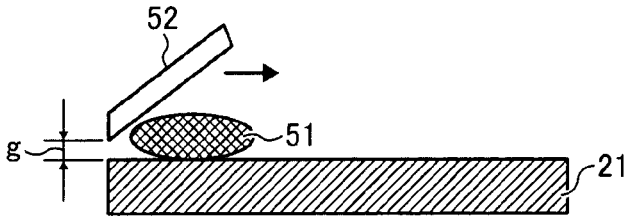
Figure 7C:
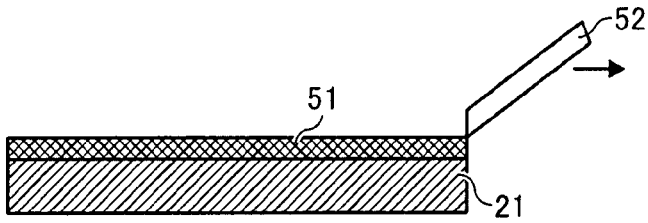

As illustrated in FIGS. 7B and 7C, after the metal element 21 (e.g., SUS 304-TA) is prepared by surface treatment, a polyamic acid varnish 51, which is a precursor of polyimide, is applied on the metal element 21 by moving a blade 52 over the metal element 21 while maintaining a given gap "g" from the surface of the metal element 21.

In addition to such method, the polyamic acid varnish 51 can be applied on the metal element 21 by known methods such as dipping method, which dips a metal element in a solution of polyamic acid varnish, and spray coating method, or the like for example.

Figure 7D:
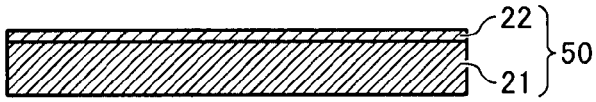

As illustrated in FIG. 7D, the polyamic acid varnish 51 applied on the metal element 21 is dried at a given temperature (e.g., 120 degrees Celsius), and a temperature is gradually increased to another given temperature (e.g., 360 degrees Celsius) for imidization, by which the resin layer 22 is formed on the metal element 21.

Although polyimide is used as resin material in an example embodiment, other resin material can be used by adjusting drying temperature, imidization temperature depending on ingredient of resin material.

With a process illustrated in FIG. 7, the layered member 50 can be prepared without using an adhesive agent, wherein the layered member 50 may have a good layer adhesiveness and dimensional stability of layers.

The resin material used in an example embodiment is prepared from a plurality of varnish compounds to set a coefficient of linear expansion of resin material greater than a coefficient of linear expansion of metal material, for example.

Therefore, even when the metal element 21 is etched, an occurrence of wrinkles on the resin layer 22 may be suppressed, by which a variation in droplet discharge performance among nozzles can be suppressed.

In an example embodiment, the polyamic acid varnish 51 is applied with a given amount so that the resin layer 22 has a given thickness such as 6 μm. Preferably, the resin layer 22 has a thickness of 3 μm to 7 μm to set a better liquid discharge performance of the liquid dispenser head H, and furthermore, a variation in layer thickness of the resin layer 22 is preferably set to 0.5 μm or less. The metal element 21 made of SUS 304-TA has a thickness of 20 μm, for example.

The thickness of the metal element 21 may be determined considering an etching for forming the island portion 2B, wherein the etching can be conducted easily if the thickness of the metal element 21 is thinner.

However, if the thickness of the metal element 21 becomes too small or thin, a stiffness of the layered member 50 composed of the resin layer 22 and the metal element 21 becomes smaller, which is not preferable for etching process and part assembly process. Accordingly, the metal element 21 preferably has a thickness of 10 μm to 25 μm, for example.

Other than such varnish method, a metal mold method can be used to prepare the layered member 50, in which SUS material (e.g., SUS 304-TA) is filled in a metal mold and the polyamic acid varnish 51 is filled in the metal mold, and then a solidification is conducted to form the resin layer 22 on the metal element 21. However, a size of metal mold may become greater if a longer head such as page-wide array head is manufactured, by which a manufacturing and maintenance cost of metal mold may become expensive compared to a varnish method.

A description is now given to a process of etching the layered member 50 to form the vibration member 2 with reference to FIG. 8, in which the metal element 21 is etched.

Figure 8A:
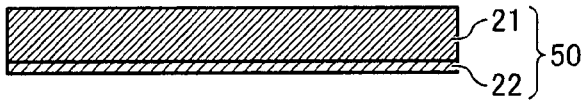
FIG. 8 illustrates a process for making a vibration plate from the base member of FIG. 7.

First, the layered member 50, having the metal element 21 and the resin layer 22 bonded together without using an adhesive agent prepared in a process illustrated in FIG. 7, is placed as illustrated in FIG. 8A.

Figure 8B:
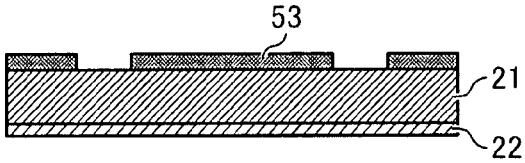

As illustrated in FIG. 8B, an etching mask 53 having a given pattern is formed on the metal element 21 (e.g., SUS 304-TA). Because a SUS material has a relatively weak adhesiveness with the etching mask 53 used as resist, such SUS material may be processed by plasma technique in an inert gas (e.g., argon, nitrogen) to increase adhesiveness of SUS material before applying the etching mask 53. Moreover, adhesiveness of SUS material can be increased with a chemical treatment using hydrochloric acid, for example.

Figure 8C:
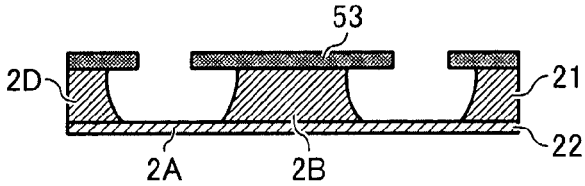
Figure 8D:
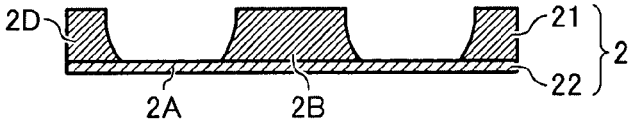

Then, as illustrated in FIG. 8C, an etching for the masked metal element 21 is conducted by contacting an etchant, mainly composed of ferric chloride, to form the island portion 2B and the pillar portion 2D. After such etching, the etching mask 53 is removed to prepare the vibration member 2 as illustrated in FIG. 8D.

In such process illustrated in FIGS. 8A to 8D, a portion to be formed as protruded portion (e.g., island portion 2B) of the vibration member 2 is masked when etching the metal plate 21. In other words, a thickness of such protruded portion may not be affected during the etching.

Accordingly, the thickness of such protruded portion may be a height of a metal material used as the metal plate 21, and the thickness (or height) of such protruded portion can be controlled effectively by controlling a thickness of metal material, which can be controlled easily.

In an example embodiment, because the piezoelectric element 12 is bonded to such protruded portion of the vibration member 2 having a smaller variation on height (or having a effectively controlled height), a variation in bonding strength between the metal plate 21 and the piezoelectric element 12 can be suppressed.

Accordingly, the piezoelectric element 12 can transmit energy (e.g., displacement of piezoelectric element) to the vibration portion 2A efficiently with less variation in energy transmission efficiency, by which a vibration of droplet discharge performance among nozzles can be suppressed.

A description is now given to a process of bonding the vibration member 2 with the piezoelectric element 12 with reference to FIG. 9.

Figure 9A:
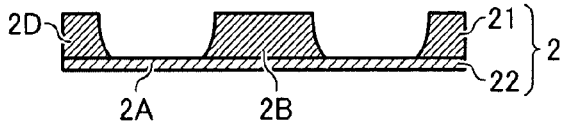
FIG. 9 illustrates a process for bonding the vibration plate of FIG. 8 to a piezoelectric element.

First, the vibration member 2, having the island portion 2B on the metal element 21 and the resin layer 22 prepared in a process illustrated in FIG. 8, is placed as illustrated in FIG. 9A.

Because the island portion 2B is bonded to the resin layer 22 without using an adhesive agent, a thickness of the island portion 2B can be controlled within a thickness variation in a base material of the metal element 21, wherein the thickness of such base material can be effectively controlled.

Figure 9B:
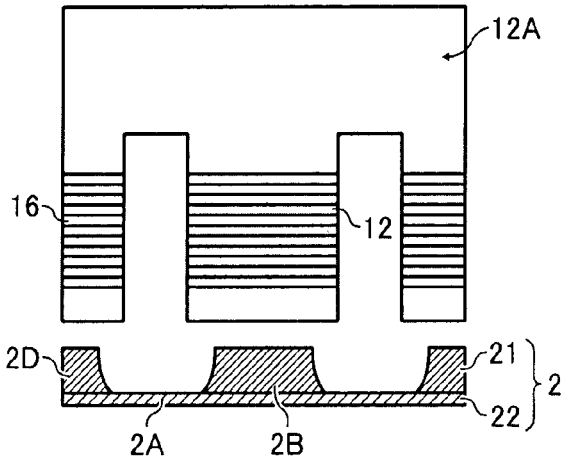

As illustrated in FIG. 9B, the piezoelectric element 12 having a piezoelectric constant of d33 is prepared from the piezoelectric element block 12A.

As above described, the piezoelectric element 12 having piezoelectric constant of d33 includes the piezoelectric layer 121 and the internal electrode 122, wherein the piezoelectric layer 121 is made of lead zirconium titanate (PZT) having a thickness of 10 μm to 50 μm per layer, and the internal electrode 122 is made of silver/palladium (AgPd) having a thickness of several μm per layer, for example. More specifically, a plurality of piezoelectric layers 121 and a plurality of internal electrodes 122 are alternately stacked each other. Such internal electrode 122 has an end face, which is connected to an external electrode (not illustrated).

Figure 9C:
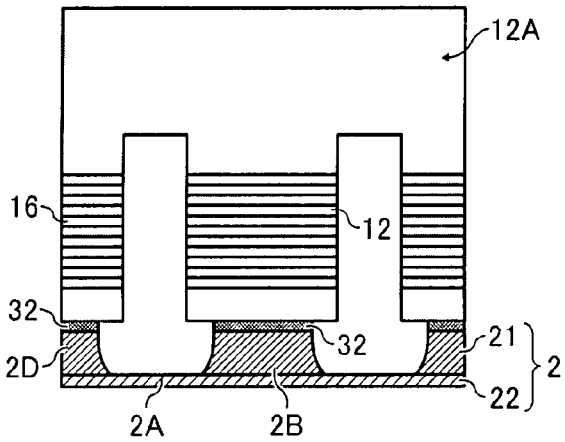

As illustrated in FIG. 9C, the piezoelectric element 12 is bonded to the island portion 2B of the vibration member 2 with the adhesive agent 32.

With a process illustrated in FIGS. 9A to 9C, the piezoelectric element 12 can be bonded to the island portion 2B having a smaller variation on thickness, wherein the thickness of island portion 2B can be controlled effectively as above described.

Accordingly, a variation in bonding strength between the metal plate 21 and the piezoelectric element 12 can be suppressed, and the piezoelectric element 12 can transmit energy (e.g., displacement of piezoelectric element) to the vibration portion 2A efficiently with less variation in energy transmission efficiency, by which a vibration of droplet discharge performance among nozzles can be suppressed.

Furthermore, bonding faces of the island portion 2B and the piezoelectric element 12 may be set to have improved flatness. The improved flatness of bonding faces of the island portion 2B and the piezoelectric element 12 enables the metal plate 21 and the piezoelectric element 12 to be bonded together more reliably, thereby improving yield of the liquid dispensing head H.

Figure 11:
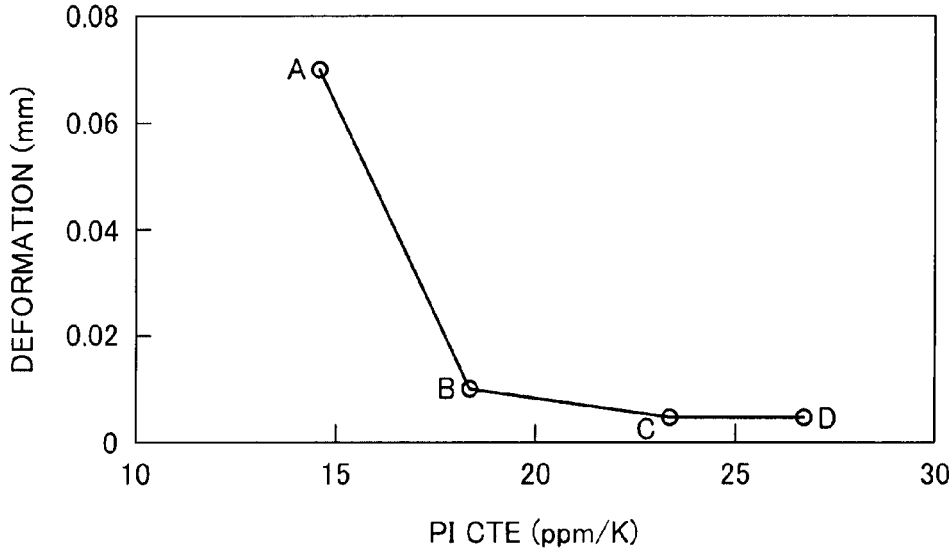
FIG. 11 is a graph for illustrating a relationship of coefficient of thermal expansion of the resin layer and deformation of the resin layer.

A description is now given to a deformation of the resin layer 22 of the vibration member 2 with reference to FIGS. 10 and 11.

As illustrated in FIG. 10, four compounds A, B, C, D were prepared from a plurality of polyamic acid varnishes and used as precursor of polyimide to form the resin layer 22 (e.g., polyimide layer). Each compound A, B, C, D had different coefficient of linear expansion (CTE ppm/K).

A thickness of the resin layer 22 was set to 6 μm, a thickness of the metal element 21 made of SUS 304-TA was set to 20 μm, and the coefficient of linear expansion of the metal element 21 was set to 17 ppm/K to 18 ppm/K.

An etching was conducted to a layered member composed of the resin layer 22 and the metal element 21 (SUS 304-TA), bonded each other without using an adhesive agent, by contacting an etchant, mainly composed of ferric chloride, to the metal element 21 to prepare a resin-only layer having a size of 4.5×4.5 mm area on the resin layer 22, by which the metal element 21 is removed from such 4.5×4.5 mm area.

Figure 12:
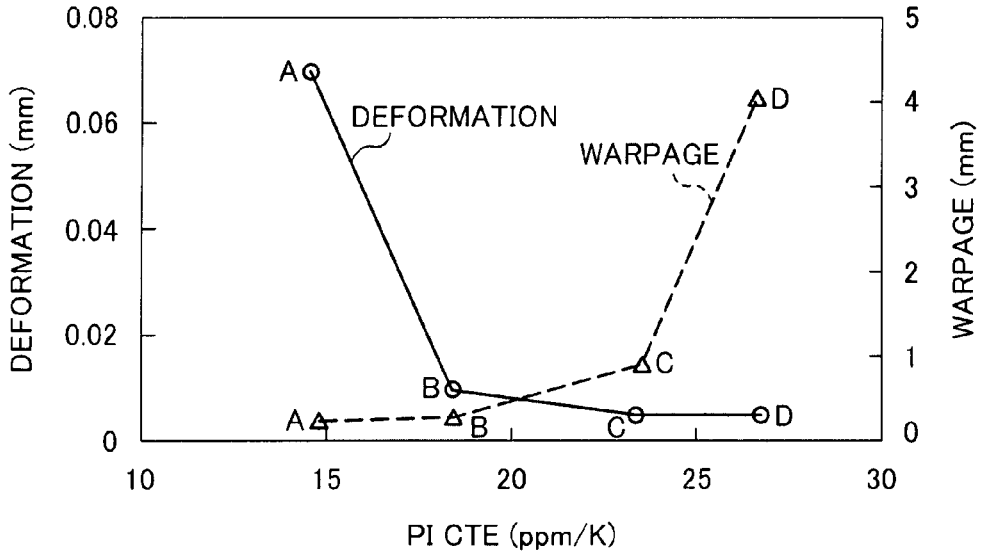
FIG. 12 is a graph for illustrating a relationship of deformation and warpage with respect to a coefficient of thermal expansion of the resin layer of the vibration plate.

FIG. 10 illustrates measurement results of deformation of surface shape of the resin-only layer (i.e., 4.5×4.5 mm area) of the resin layer 22. In FIGS. 10 to 12, "CTE" means "coefficient of thermal expansion" (ppm/K) of polyimide, which means coefficient of linear expansion. FIG. 11 illustrates graphically the measurement results shown in FIG. 10, in which compound A, B, C, and D are indicated with a circle.

Based on the results shown in FIGS. 10 and 11, it was confirmed that a resin layer made of compound A, having a coefficient of linear expansion smaller than the metal element 21, had a relatively greater surface deformation, and a layer made of compounds B, C, or D, having a coefficient of linear expansion greater than the metal element 21, had a relatively smaller surface deformation.

Further, it was confirmed that a liquid dispensing head using compound A had unacceptable level of discharge performance indicated by a mark of "X" and a liquid dispensing head using compounds B, C, D had acceptable level of discharge performance indicated by a mark of "O."

By using the resin layer 22 prepared from compounds A, B, C, and D shown in FIG. 10, the resin layer 22 was cured on the metal element 21 at a relatively higher temperature of 250 to 400 degrees Celsius, by which the resin layer 22 was fixed on the metal element 21.

In case of compound A, the resin layer 22 had a coefficient of linear expansion smaller than the metal element 21. In such a case, when the temperature is cooled to a room temperature after removing the metal element 21 by etching, the resin layer 22 had a surface deformation at such room temperature, which is lower than a curing temperature of resin.

In case of compounds B, C, and D, the resin layer 22 had a coefficient of linear expansion greater than the metal element 21. In such a case, when the temperature is cooled to a room temperature after removing the metal element 21 by etching, the resin layer 22 had a surface uniformly tensioned with a given preferable condition at such room temperature, which is lower than a curing temperature of resin.

As illustrated in the graph of FIG. 11 showing results of FIG. 10, a deformation of the resin layer for compounds B, C, and D having a coefficient of linear expansion greater than the metal element 21 was significantly smaller than a deformation of the resin layer for compound A having a coefficient of linear expansion smaller than the metal element 21.

Furthermore, a warpage of the layered product composed of the metal element 21 and the resin layer 22 was also measured for compounds A, B, C, and D, and measurement results are shown in FIG. 12, in which a warpage was measured for the layered product having a given size such as 75 mm.

In FIG. 12, compound A, B, C, and D indicated with a circle represent results of deformation of the resin layer, and compound A, B, C, and D indicated with a triangle represent results of warpage of the layered product.

In this disclosure, warpage may mean a curving of layer, which is originally flat or straight, and deformation may mean surface deformation of layer such as wrinkles.

As illustrated in FIG. 12, the greater the coefficient of linear expansion of the resin layer 22, the greater the warpage of the layered product. For example, the warpage for compound D was significantly greater than the warpage for compound C.

Based on the results shown in FIGS. 11 and 12, it was confirmed that deformation of the resin layer 22 and warpage of the layered product may have an opposite trend, and it was also confirmed that a coefficient of linear expansion, which is in the middle of the coefficient of linear expansion for compound B and compound C, was preferably used for the resin layer 22 to effectively suppress an effect of deformation and warpage.

Accordingly, when the resin layer 22 is formed directly on the metal plate 21 having a coefficient of linear expansion of 17 ppm/K to 18 ppm/K, the resin layer 22 preferably has a coefficient of linear expansion, which is greater than the metal plate 21 and smaller than 23.5 ppm/K, to suppress a deformation of the resin layer 22 and a warpage of layered product.

Theoretically, wrinkles on the resin layer 22 may be suppressed if the resin layer 22 and the metal plate 21 have a same coefficient of linear expansion. However, it is very difficult to prepare the resin layer 22 and the metal plate 21 having a same coefficient of linear expansion considering manufacturing variation in parts (e.g., resin material).

Further, if the resin layer 22 has a coefficient of linear expansion smaller than the metal plate 21, a deformation of the resin layer 22 may become greater.

In an example embodiment, the resin layer 22 has a coefficient of linear expansion greater than the metal plate 21, by which an occurrence of wrinkles at a vibration portion and a damping section can be suppressed, and a variation in droplet discharge performance among nozzles in the liquid dispenser head H can be suppressed.

In an example embodiment, a variation in thickness or height of protruded portion (e.g., island portion 2B) can be suppressed effectively because a thickness or height of protruded portion can be controlled by controlling a thickness of a base material of metal plate 21, which can be conducted relatively easily.

Accordingly, a variation in bonding strength between the metal plate 21 and the piezoelectric element 12 can be suppressed, and the piezoelectric element 12 can transmit energy (e.g., displacement of piezoelectric element) to the vibration portion 2A efficiently with less variation in energy transmission efficiency, by which a vibration of droplet discharge performance among nozzles can be suppressed.

Furthermore, because the liquid dispenser head according to an example embodiment has a higher reliability on droplet discharge performance, a liquid dispensing unit employing the liquid dispenser head can have a higher reliability on droplet discharge performance, and an image forming apparatus employing such liquid dispensing unit can enhance image quality of printed image.

Figure 13:
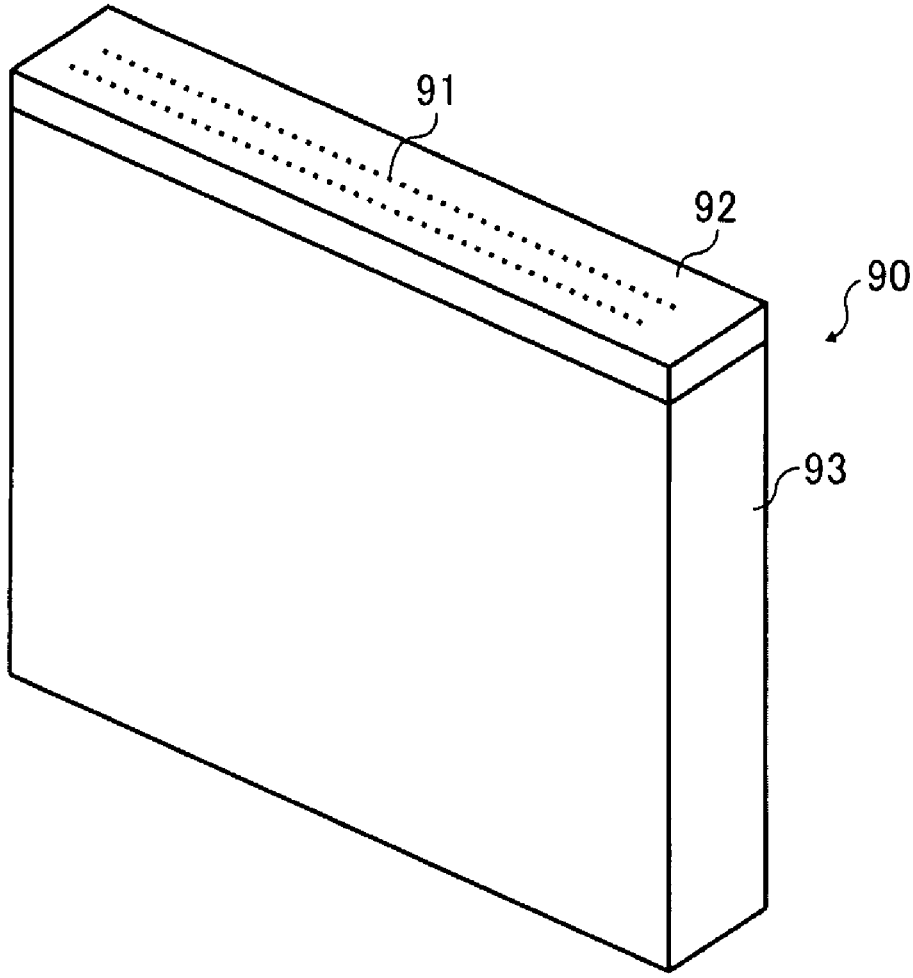
FIG. 13 illustrates a perspective view of another liquid dispenser head according to another example embodiment.

Another liquid dispenser head according to another example embodiment is illustrated in FIG. 13, which illustrates a perspective view of a liquid dispenser head 90. The liquid dispenser head 90 includes a nozzle face 92 having a nozzle 91 and a tank 93 for storing recording liquid, by which a liquid dispenser assembly having nozzles and tank as one unit is obtained.

Figure 14:
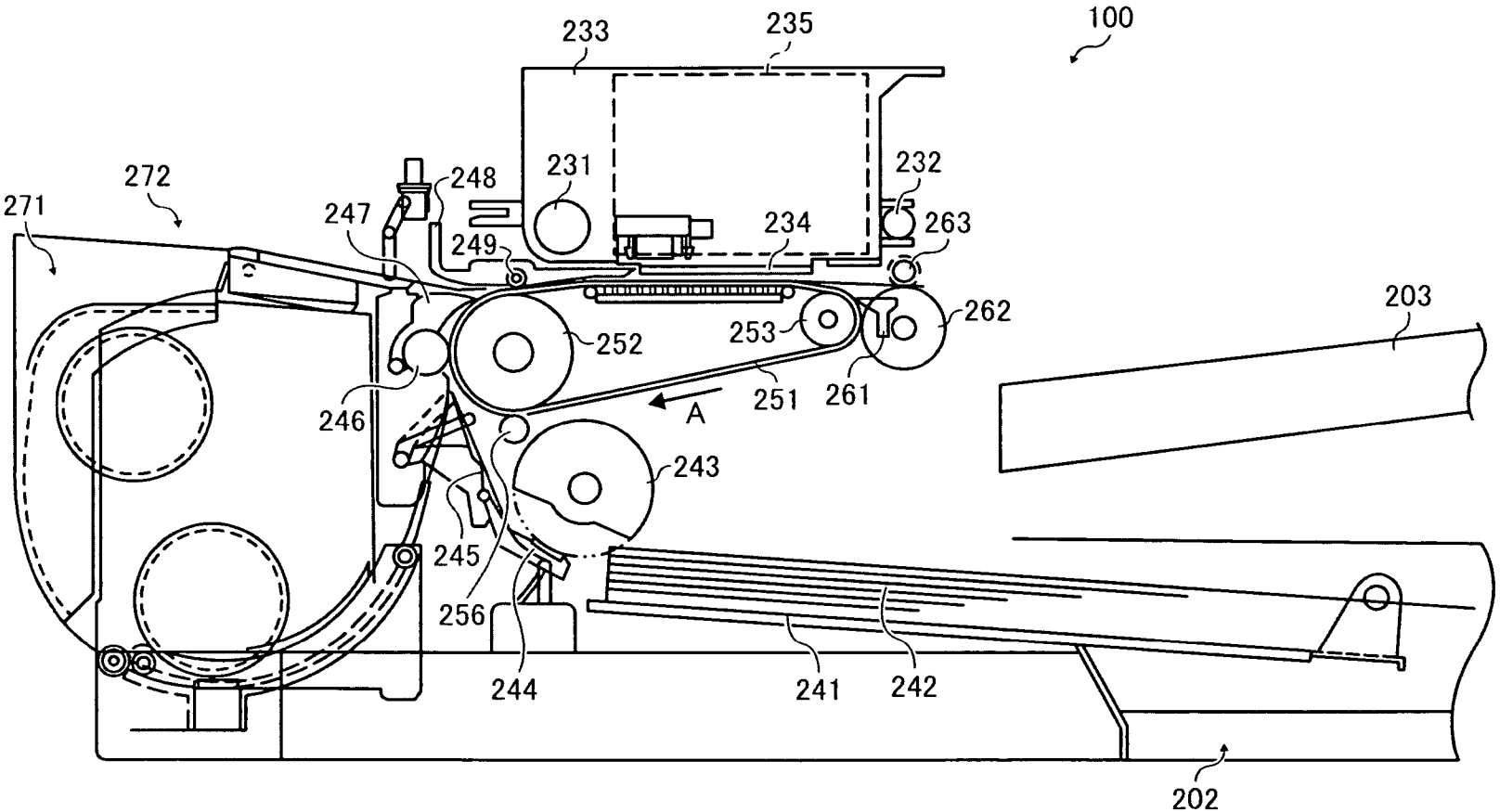
FIG. 14 illustrates a schematic configuration of an image forming apparatus according to an example embodiment.
Figure 15:
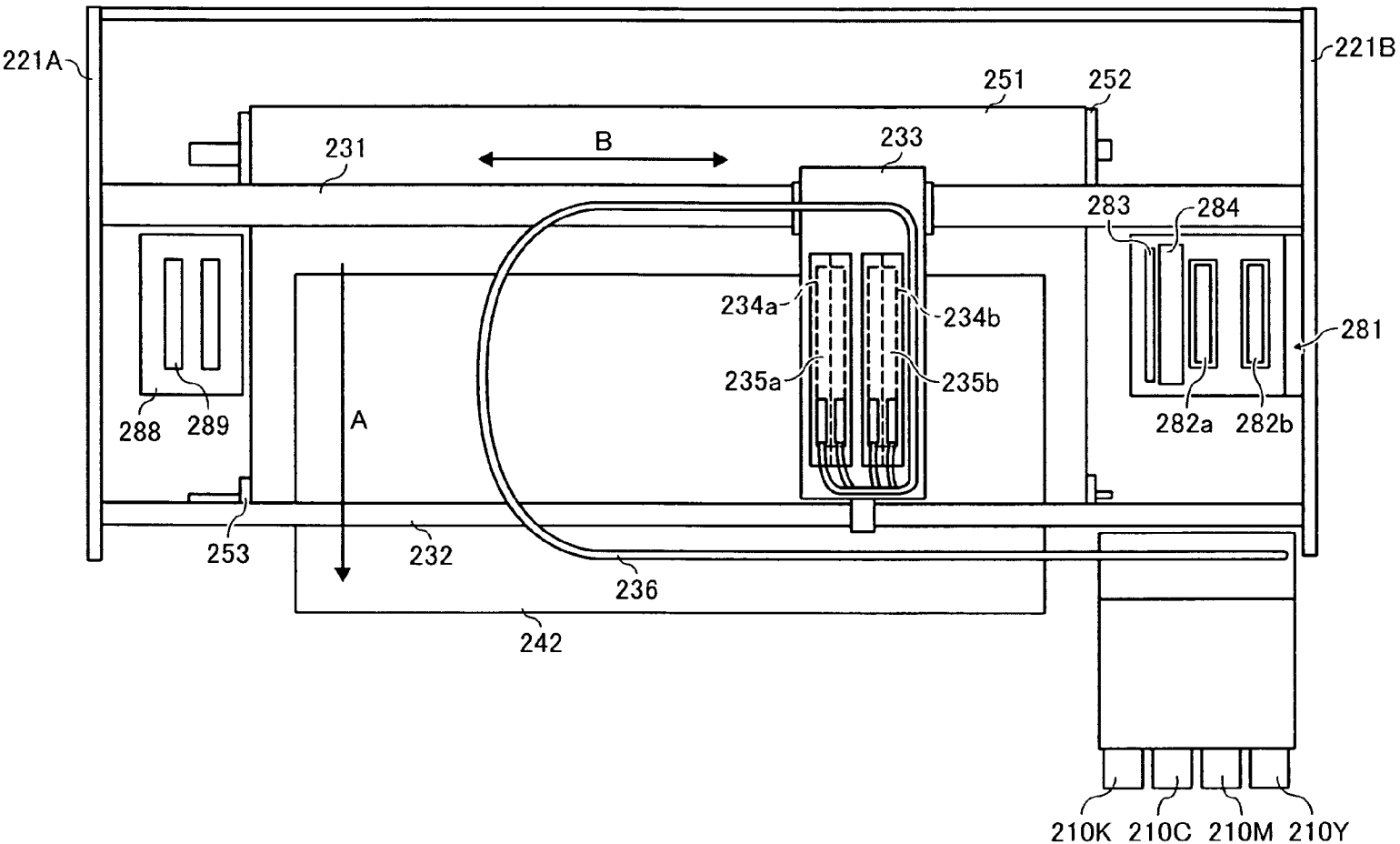
FIG. 15 illustrates a plan view of an image forming section in the image forming apparatus of FIG. 14.

A description is now given to an image forming apparatus having a liquid dispensing head or liquid dispensing unit according to example embodiment with reference to FIGS. 14 and 15.

FIG. 14 is a schematic view for illustrating a configuration of an image forming apparatus 100 according to an example embodiment, and FIG. 15 is a plan view of a recording section of the image forming apparatus 100. The image forming apparatus 100 may be a serial type, which produces one line image step by step, for example.

As illustrated in FIGS. 14 and 15, the image forming apparatus 100 includes guide rods 231 and 232 extending between side plates 221A and 221B of the image forming apparatus 100. A carriage 233 can be moved in a main scanning direction in the image forming apparatus 100 with a guide of the guide rods 231 and 232. Specifically, the carriage 233 can be slidably moved in a main scanning direction shown by an arrow B in FIG. 15 with a motor and a timing belt (not illustrated).

As illustrated in FIG. 15, the carriage 233 includes recording heads 234*a* and 234*b* according to example embodiments for discharging droplets of recording liquid (e.g., ink) of yellow (Y), cyan (c), magenta (M), and black (K). The recording heads 234*a* and 234*b* may be collectively referred as recording head 234.

The recording head 234 includes a plurality of nozzles for discharging droplets of recording liquid (e.g., ink), wherein such plurality of nozzles are arranged in one direction perpendicular to a main scanning direction of a recoding medium, and may discharge droplets in a downward direction in FIG. 14.

As illustrated in FIG. 15, the recording head 234*a* is provided with two nozzle arrays, in which one nozzle array discharges recording liquid of black (K) and other nozzle array discharges recording liquid of cyan (c), for example. Similarly, the recording head 234*b* is provided with two nozzle arrays, in which one nozzle array discharges recording liquid of magenta (M) and other nozzle array discharges recording liquid of yellow (Y), for example.

As illustrated in FIG. 15, the carriage 233 includes sub-tanks 235*a* and 235*b* for supplying recording liquid (e.g., ink) of different colors to each of the recording heads 234*a* and 234*b*.

The sub-tank 235 can be connected to a main tank 210 (210K, 210C, 210M, 210Y) such as ink cartridge via a supply tube 236 so that the recording liquid (e.g., ink) can be supplied to the sub-tank 235 from the main tank 210.

As illustrated in FIG. 14, a sheet feed section includes a sheet cassette 202, a sheet stacking tray 241, a sheet 242, a sheet feed roller 243 shaped in half-moon, and a separation pad 244 made of material having a relatively greater friction coefficient, in which the separation pad 244 is biased toward the sheet feed roller 243.

The sheet feed roller 243 and the separation pad 244, which face each other, are used to feed the sheet 242 one by one to a transport section, to be described later, from the sheet stacking tray 241. As illustrated in FIG. 14, a plurality of sheets (i.e., sheet 242) can be stacked on the sheet stacking tray 241 of the sheet cassette 202.

As illustrated in FIG. 14, the transport section includes a transport belt 251, a guide 245, a counter roller 246, a transport guide 247, a press member 248, a pressure roller 249, and a charge roller 256. Such transport section is used to transport the sheet 242 from the sheet feed section to a recording section in the image forming apparatus 100.

As illustrated in FIG. 14, the transport belt 251 of endless type is extended by a transport roller 252 and a tension roller 253, and such transport belt 251 travels in one direction to feed the sheet 242 to the recording section. The charge roller 256 can charge the transport belt 251 so that a surface of transport belt 251 can electro-statically adhere the sheet 242 thereon and transport the sheet 242 to the recording section. The transport roller 252, which is rotated by a motor (not illustrated), is used to travel the transport belt 251 in one direction.

After printing an image to the sheet 242 with the recording head 234 in the recording section, the sheet 242 is ejected to an ejection tray 203 with an ejection unit. Such ejection unit includes a separation claw 261, and ejection rollers 262 and 263. After forming an image on the sheet 242, the separation claw 261 separates the sheet 242 from the transport belt 251, and the sheet 242 is ejected to the ejection tray 203 by the ejection rollers 262 and 263.

The image forming apparatus 100 further includes a sheet-inverting unit 271 on a rear side of the image forming apparatus 100 as illustrated in FIG. 14, wherein the sheet-inverting unit 271 may be detachable from the image forming apparatus 100 and may have a manual feed tray 272.

The sheet-inverting unit 271 receives the sheet 242 from the transport belt 251 when the transport belt 251 travels in a direction opposite to the direction shown by an arrow A, and inverts faces of the sheet 242. Then, the sheet-inverting unit 271 feeds the face-inverted sheet 242 to a space between the counter roller 246 and the transport belt 251.

Furthermore, as illustrated in FIG. 15, a refreshing unit 281 is provided on one end side of the image forming apparatus 100, wherein the refreshing unit 281 is used to maintain a nozzle condition and to refresh the nozzle of the recording head 234.

As illustrated in FIG. 15, the refreshing unit 281 includes capping members 282*a* and 282*b*, a wiping blade 283, a dummy discharge receiver 284, for example.

The capping members 282*a* and 282*b* are used for capping a nozzle face of the recording head 234, and the wiping blade 283 is used to wipe the nozzle face of the recording head 234.

The dummy discharge receiver 284 is used for receiving droplets when a dummy discharging operation is conducted, wherein the dummy discharging operation is conducted by discharging fresh recording liquid (e.g., ink) from the nozzle without actual printing, by which viscosity-increased ink adhered on the nozzle of the recording head 234 may be removed from the recording head 234.

The image forming apparatus 100 further includes an ink recovery unit 288 having an opening 289, matched to a size of nozzle array of the recording head 234 as illustrated in FIG. 15. The ink recovery unit 288 is used to receive ink, which may be discharged during a dummy discharge of recording liquid while conducting image forming operation.

In the image forming apparatus 100, the sheet feed section feeds the sheet 242 one by one to the transport section. Then, the sheet 242 is guided by the guide 245, and transported to the space between the counter roller 246 and the transport belt 251. Then, the sheet 242 is guided by the transport guide 247 and pressed to the transport belt 251 by the pressure roller 249.

During such sheet transportation, a positive voltage and negative voltage current are supplied to the charge roller 256 from a high voltage power source (not illustrated) alternately. Therefore, the transport belt 251 is alternately charged with positive and negative voltage, thereby positive voltage charged areas and negative voltage charged areas are formed on the transport belt 251 alternately.

When the sheet 242 is fed on such charged transport belt 251, the sheet 242 is electro-statically adhered on the transport belt 251, and is transported to the recording section with a traveling of the transport belt 251.

As illustrated in FIG. 15, the carriage 233 having the recording head 234 can be moved in a direction shown by an arrow B over the sheet 242.

The recording head 234 discharges droplets (e.g., ink) onto the sheet 242 to record one line image on the sheet 242 when the carriage 234 moves in a direction shown by an arrow B.

During an image forming operation, a transportation of the sheet 12 is stopped for recording one line image on the sheet 242. When the recording of one line image completes, the sheet 242 is transported for a given distance and another one line image is recorded on the sheet 242 by discharging droplets (e.g., ink) onto the sheet 242. Such recording process is repeated for one page. When such recording operation completes for one page, the sheet 242 is ejected to the ejection tray 203.

Such image forming apparatus 100 of serial type having a liquid dispenser head or liquid dispensing unit according to example embodiments can produce an higher quality image with a higher speed because a liquid dispenser head or liquid dispensing unit according to example embodiments can reliably dispense recording liquid.

Figure 16:
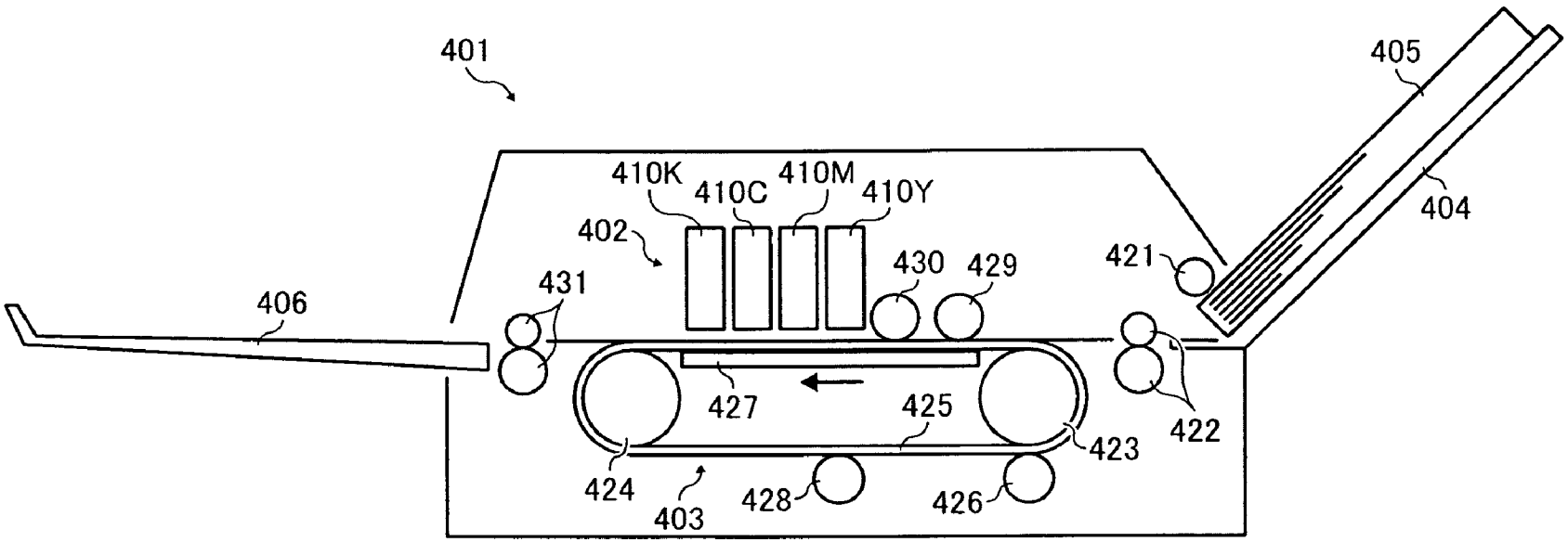
FIG. 16 illustrates a schematic configuration of another image forming apparatus according to example embodiment.

A description is now given to an image forming apparatus having a liquid dispenser head or liquid dispensing unit according to example embodiments with reference to FIG. 16.

FIG. 16 is a schematic view illustrating a configuration of an image forming apparatus 401 having a liquid dispenser head or liquid dispensing unit according to example embodiments. The image forming apparatus 401 may be a line type having a line head for the liquid dispensing unit, in which one line image is produced by single dispensing operation from the line head because the line head has a width matched to a sheet width.

The image forming apparatus 401 includes an image forming section 402, a transport unit 403, a sheet feed tray 404, and a sheet ejection tray 406, for example. Sheet 405 stacked on the sheet feed tray 404 is transported to the image forming section 402 by the transport unit 403, then recorded with an image in the image forming section 402, and is ejected to the sheet ejection tray 406.

The image forming section 402 includes line head units 410Y, 410M, 410C, and 410K, held by a head holder (not illustrated). Each of the line head units 410Y, 410M, 410C, and 410K may be integrated with a tank for storing recording liquid, and has a nozzle array having a length matched to a sheet width, which is a in a direction perpendicular to a sheet transport direction.

Each of the line head units 410Y, 410M, 410C, and 410K dispenses recording liquid of yellow, magenta, cyan, and black, respectively, onto the sheet 405.

Alternatively, such line head units 410Y, 410M, 410C, and 410K may not be integrated with a tank for storing recording liquid.

The sheet 405 on the sheet feed tray 404 is separated one by one by a separation roller 421, and fed to the transport unit 403 by a feed roller 422.

The transport unit 403 includes a transport belt 425, a charge roller 426, a guide plate 427, a cleaning roller 428, a de-charge roller 429, and a pressure roller 430, for example.

In the transport unit 403, the transport belt 425, extended by a drive roller 423 and a driven roller 424, is charged by the charge roller 426. The guide plate 427 supports the transport belt 425 in the image forming section 402. The cleaning roller 428, made of porous material, removes recording liquid (e.g., ink) adhered on the transport belt 425. The de-charge roller 429, mainly made of conductive rubber, de-charges the sheet 405. The pressure roller 430 presses the sheet 405 to the transport belt 425.

The sheet 405 having a recorded image thereon is ejected to the sheet ejection tray 406 by an ejection roller 431, provided at a sheet exit side of the transport unit 403.

As such, in the image forming apparatus 401 having line head units, the sheet 405 fed and adhered on the transport belt 425 is recorded with an image in the image forming section 402 while transported in one direction with a traveling of the transport belt 425, and ejected to the sheet ejection tray 406 after forming an image on the sheet 405.

Such image forming apparatus 401 having a liquid dispenser head or liquid dispensing unit according to example embodiments can produce an higher quality image with a higher speed because a liquid dispenser head or liquid dispensing unit according to example embodiments can reliably dispense recording liquid.

The above-described liquid dispensing unit and image forming apparatus according to example embodiments can be applied to a printer, a facsimile, a copier or a multifunctional apparatus having printer/facsimile/copier function. Furthermore, the above-described liquid dispensing unit can be applied to any apparatus, which dispenses liquid.

Numerous additional modifications and variations are possible in light of the above teachings. It is therefore to be understood that within the scope of the appended claims, the disclosure of the present invention may be practiced otherwise than as specifically described herein.

What is claimed is:

1. A liquid dispenser head, comprising:

a plurality of nozzles configured to discharge liquid;

a plurality of liquid chambers, each one of the plurality of liquid chambers configured to communicate with one of the plurality of nozzles; and a plurality of vibration members each having a vibration portion used as a deformable wall face of one of the plurality of liquid chambers, each one of the plurality of vibration members including a metal member and a resin layer formed directly on the metal member, and the resin layer having a coefficient of linear expansion greater than a coefficient of linear expansion of the metal member.

2. The liquid dispenser head according to claim 1, wherein the resin layer is a polymer having an imide bond.

3. The liquid dispenser head according to claim 1, wherein the vibration portion includes a first portion formed only of resin material and the first portion extends over an entire width of the vibration member.

4. The liquid dispenser head according to claim 3, wherein the first portion is formed on the vibration member by removing a corresponding portion of the metal member of the vibration member by etching.

5. The liquid dispenser head according to claim 1, further comprising a shared liquid chamber configured to supply liquid to the plurality of liquid chambers, wherein the vibration member includes a damping section formed from the resin layer of the vibration member and used as a deformable wall face of the shared liquid chamber.

6. The liquid dispenser head according to claim 1, further comprising a liquid tank configured to supply the liquid to the liquid dispenser head, wherein the liquid tank is integrated with the liquid dispenser head.

7. The liquid dispenser head according to claim 1, wherein the resin layer is constituted by a resin material that has a coefficient of linear expansion greater than a coefficient of thermal expansion of the metal member.

8. The liquid dispenser head according to claim 1, wherein the resin layer is constituted by a polyimide that has a coefficient of linear expansion greater than the coefficient of linear expansion of the metal member.

9. The liquid dispenser head according to claim 1, wherein the coefficient of linear expansion of the resin layer is smaller than 23.5 ppm/K and greater than the coefficient of linear expansion of the metal member.

10. The liquid dispenser head according to claim 1, wherein the resin layer has a thickness in a range of about 3 μm to 7 μm, and the metal member has a thickness in a range of about 10 μm to 25 μgm.

11. An image forming apparatus, comprising:

a liquid dispenser head including:

a plurality of nozzles configured to discharge liquid;

a plurality of liquid chambers, each one of the plurality of liquid chambers configured to communicate with one of the plurality of nozzles; and a plurality of vibration members each having a vibration portion used as a deformable wall face of one of the plurality of liquid chambers, each one of the plurality of vibration members including a metal member and a resin layer formed directly on the metal member, and the resin layer having a coefficient of linear expansion greater than a coefficient of linear expansion of the metal member.

* * * * *